US011447926B2

(12) United States Patent
Musciagna et al.

(10) Patent No.: US 11,447,926 B2
(45) Date of Patent: Sep. 20, 2022

(54) METHOD AND A SYSTEM FOR CONTROLLING THE GROUND GRIP OF A WHEELED LOADER

(71) Applicant: Dana Motion Systems Italia S.R.L., Reggio Emilia (IT)

(72) Inventors: Nicola Francesco Musciagna, San Giovanni in Persiceto (IT); Pier Paolo Rinaldi, Arco (IT)

(73) Assignee: Dana Motion Systems Italia S.R.L., Reggio Emilia (IT)

( * ) Notice: Subject to any disclaimer, the term of this patent is extended or adjusted under 35 U.S.C. 154(b) by 364 days.

(21) Appl. No.: 16/840,189

(22) Filed: Apr. 3, 2020

(65) Prior Publication Data

US 2020/0318311 A1 Oct. 8, 2020

(51) Int. Cl.

| | |
|---|---|
| ***E02F 3/43*** | (2006.01) |
| ***E02F 3/34*** | (2006.01) |
| ***E02F 3/42*** | (2006.01) |
| ***E02F 9/20*** | (2006.01) |
| ***E02F 9/22*** | (2006.01) |

(52) U.S. Cl.

CPC ..... *E02F 3/431* (2013.01); *E02F 3/34* (2013.01); *E02F 3/422* (2013.01); *E02F 9/2037* (2013.01); *E02F 9/2267* (2013.01)

(58) Field of Classification Search

CPC ... E02F 3/34; E02F 3/422; E02F 3/431; E02F 9/0841; E02F 9/2025; E02F 9/2037; E02F 9/2267

See application file for complete search history.

(56) References Cited

U.S. PATENT DOCUMENTS

| | | | | |
|---|---|---|---|---|
| 4,892,155 | A * | 1/1990 | Wanamaker | E02F 3/3414 172/199 |
| 6,439,332 | B1 * | 8/2002 | Meurer | B60S 9/20 180/209 |
| 6,585,071 | B2 * | 7/2003 | Meurer | B62D 61/12 180/209 |
| 2009/0112409 | A1 * | 4/2009 | Tollenaar | B66F 9/07559 701/50 |
| 2013/0085646 | A1 * | 4/2013 | Nishiwaki | B66F 9/24 701/50 |
| 2014/0299417 | A1 * | 10/2014 | Haythorne | B66F 9/20 187/222 |
| 2016/0236922 | A1 * | 8/2016 | Merlo | B66F 17/003 |

FOREIGN PATENT DOCUMENTS

| | | |
|---|---|---|
| JP | H0649866 A | 2/1994 |

* cited by examiner

*Primary Examiner* — Tyler J Lee
(74) *Attorney, Agent, or Firm* — McCoy Russell LLP

(57) ABSTRACT

A method for controlling the ground grip of a wheeled loader having a pair of front wheels, a bucket, and at least one boom, comprising measuring the relative position of said front wheels with respect to the ground, detecting the reaching of a critical threshold value by measuring the relative position of the front wheels with respect to the ground, comparing the measurement of the relative position of the front wheels to a critical threshold value, and, when the measurement of the relative position of the front wheels with respect to the ground reaches the critical threshold value, inhibiting a further tilting of the bucket and a further lowering of the at least one boom.

20 Claims, 5 Drawing Sheets

METHOD AND A SYSTEM FOR CONTROLLING THE GROUND GRIP OF A WHEELED LOADER

CROSS-REFERENCE TO RELATED APPLICATION

The present application claims priority to Italian Patent Application No. 102019000005060, entitled "METODO E SISTEMA PER IL CONTROLLO DELLA PRESA AL SUOLO DI UNA PALA CARICATRICE GOMMATA", and filed on Apr. 4, 2019. The entire contents of the above-listed application is hereby incorporated by reference for all purposes.

FIELD

The present invention relates to a method and a system for controlling the ground grip of the wheels of a wheeled loader, particularly, although not exclusively, useful and practical in wheeled loaders engaged in the field of waste movement within a waste treatment structure, in short, a landfill.

BACKGROUND AND SUMMARY

In general, with reference to FIGS. 1A and 1B, a wheeled loader 10 is a machine for moving loose material, especially soil and/or waste, suitable to move it inside a yard, and suitable to load it onto appropriate long-distance transport trucks.

This loader 10 is defined as "wheeled" due to its drive system, which comprises four driving wheels, in particular a pair of front wheels 12*a* and a pair of rear wheels 12*b*, provided with respective tires.

The peculiar element of the wheeled loader 10 is the bucket 14, usually at the front, suitable to collect the loose material due to the front edge, commonly called "blade". The front bucket 14 is connected to the chassis of the wheeled loader 10 by means of one or two hydraulically operated booms 16.

The wheeled loader 10 comprises an assembly of hydraulic cylinders or actuators, usually with electrohydraulic control, in particular at least one hydraulic cylinder or actuator 18 configured to actuate (i.e., straighten and tilt) the front bucket 14, and at least one hydraulic cylinder or actuator (not illustrated) configured to actuate (i.e., lift and lower) each of the booms 16.

Currently, it is known that the movement of waste inside a landfill is ensured by wheeled loaders. In particular, tipper trucks, which transport waste to the landfill, are unloaded in a yard made of concrete or similar, which is kept clean by wheeled loaders, which continuously sweep the surface of the yard with their buckets. In jargon, this movement of the wheeled loaders is called "dozing".

In practice, by carrying out the dozing operation, the operator pushes the front bucket 14 of the wheeled loader 10 downwards until the front wheels 12*a* are lifted off the ground, for example as illustrated in FIG. 1B, and then advances inside the yard made of concrete or similar.

However, it is also known that wheeled loaders engaged in dozing, above all those used in landfills, have a higher transmission failure rate, above all of the rear axle, with respect to average values.

Usually, in the waste treatment sector, the wheels 12*a*, 12*b* of the wheeled loader 10 are provided with respective solid, or airless, tires, each having a weight typically above 600 kilograms, which have a higher angular inertia with respect to air-filled tires.

The mode shape of the transmission, when the front wheels 12*a* of the wheeled loader 10 are lifted off the ground, depends greatly on the properties of inertia of the tires and, in the case of solid tires, the point of maximum mode displacement, i.e., the point with maximum deformation, is in proximity of the gear of the gear wheels of said transmission, which is consequently subject to failures.

Moreover, the evenness of the surface of the yard made of concrete or similar ensures that the front wheels 12*a* remain lifted off the ground during dozing, preventing damping of the mode shape of the transmission due to friction between the front wheels 12*a* and the surface of the yard made of concrete or similar.

Finally, within the yard made of concrete or similar, adhesion between the tires and the ground ranges from excellent, due to the yard being clean and dry, to extremely poor, for example due to oily waste interposed between the tread of the tires and the yard. Each variation of adhesion, i.e., of the friction coefficient, translates into a sudden braking or into a slipping of the wheels, in both cases providing an impulse excitation to the mode shape of the transmission.

Therefore, the dozing maneuver has the drawback of lifting the front wheels 12*a* of the wheeled loader 10 off the ground, for example as illustrated in FIG. 1B. The reduction in the contact surface between the tread of the tires and the yard decreases the tensile stress capacity and, at the same time, almost completely eliminates damping of the mode shape, which is the main cause of failure of the transmission.

Currently, some manufacturers have adopted solutions to overcome this problem of reliability of the transmission. A first solution consists in reducing the tensile stress of the vehicle, which however has the drawback of the consequently reducing the performance of the wheeled loader. A second solution consists in the saturation of the actuation pressure on the front bucket, in particular by laminating the fluid to the hydraulic cylinder or actuator, which however has the drawback of consequent waste of a part of the fluid power, as well as the fact that this second solution is only possible if pressure limiting valves are provided.

An object of the embodiments described is to overcome the limits of the known art set forth above, devising a method and a system for controlling the ground grip of a wheeled loader which make it possible to reduce the transmission failure rate, above all of the relative rear axle, of wheeled loaders engaged in dozing, bringing it back to average values.

An object of the embodiments described is to conceive a method and a system for controlling the ground grip of a wheeled loader that makes it possible to avoid lifting the front wheels of the wheeled loader engaged in dozing off the ground, as for example illustrated in FIG. 1B.

Another object of the embodiments described is to devise a method and a system for controlling the ground grip of a wheeled loader that makes it possible to optimize and harmonize damping of the mode shape of the transmission of wheeled loaders engaged in dozing.

A further object of the embodiments described is to conceive a method and a system for controlling the ground grip of a wheeled loader that makes it possible to maximize the tensile stress capacity of wheeled loaders engaged in dozing, preventing slipping of the relative wheels.

Yet another object of the embodiments described is to devise a method and a system for controlling the ground grip of a wheeled loader that makes it possible to obtain improved effects with respect to those obtainable with the known art solutions and/or similar effects at lower cost and with higher performances.

Still another object of the embodiments described is to provide a method and a system for controlling the ground grip of a wheeled loader that are highly reliable, relatively simple to produce and economically competitive if compared to the known art.

These and other objects which shall be more apparent below, are achieved by a method for controlling the ground grip of a wheeled loader, said wheeled loader comprising a pair of front wheels, a bucket and at least one boom, wherein it comprises the steps of:

measuring the relative position of said front wheels with respect to the ground;

detecting the reaching of a critical threshold value by the measurement of said relative position of said front wheels with respect to the ground, comparing the measurement of said relative position of said front wheels with respect to the ground with said critical threshold value; and when the measurement of said relative position of said front wheels with respect to the ground reaches said critical threshold value, inhibiting a further tilting of said bucket and a further lowering of said at least one boom.

The objects are also achieved by a system for controlling the ground grip of a wheeled loader, said wheeled loader comprising a pair of front wheels, a bucket and at least one boom, said system comprising at least one sensor device and an electronic control unit, wherein:

said at least one sensor device is configured to measure the relative position of said front wheels with respect to the ground;

said electronic control unit is configured to detect the reaching of a critical threshold value on the part of the measurement of said relative position of said front wheels with respect to the ground, comparing the measurement of said relative position of said front wheels with respect to the ground with said critical threshold value; and when the measurement of said relative position of said front wheels with respect to the ground reaches said critical threshold value, said electronic control unit is configured to inhibit a further tilting of said bucket and a further lowering of said at least one boom.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The accompanying drawings are incorporated herein as part of the specification. The drawings described herein illustrate embodiments of the presently disclosed subject matter, and are illustrative of selected principles and teachings of the present disclosure. However, the drawings do not illustrate all possible implementations of the presently disclosed subject matter, and are not intended to limit the scope of the present disclosure in any way. Further features and advantages of the invention will be more apparent from the description of a preferred, but not exclusive, embodiment of the method and of the system for controlling the ground grip of a wheeled loader according to the invention, illustrated by way of non-limiting example with the aid of the accompanying drawings, wherein:

FIGS. 1A and 1B are shown with components in proportional size with one another and in spatially/geometrically positioned with respect to one another, according to some embodiments.

DETAILED DESCRIPTION

Figure 1A:
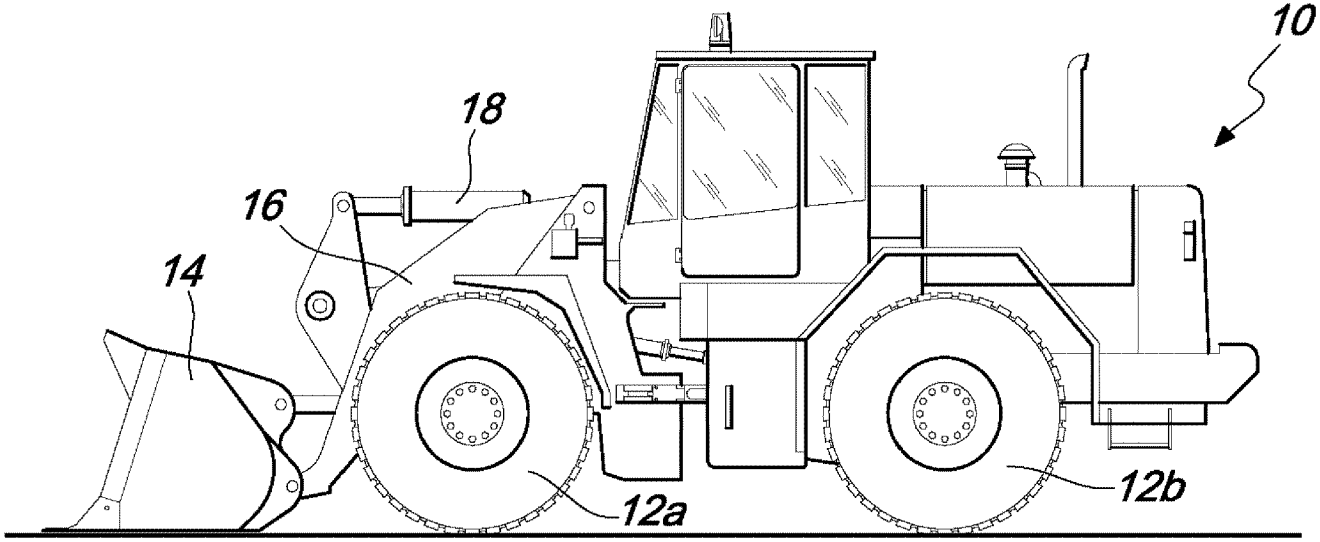
Fig. 1A PRIOR ART
FIGS. 1A and 1B are two side elevation views of a wheeled loader of a known type.

It is to be understood that the invention may assume various alternative orientations and step sequences, except where expressly specified to the contrary. It is also to be understood that the specific assemblies and systems illustrated in the attached drawings, and described in the following specification are simply exemplary embodiments of the inventive concepts defined herein. Hence, specific dimensions, directions or other physical characteristics relating to the embodiments disclosed are not to be considered as limiting, unless expressly stated otherwise. Also, although they may not be, like elements in various embodiments described herein may be commonly referred to with like reference numerals within this section of the application.

Figure 2:
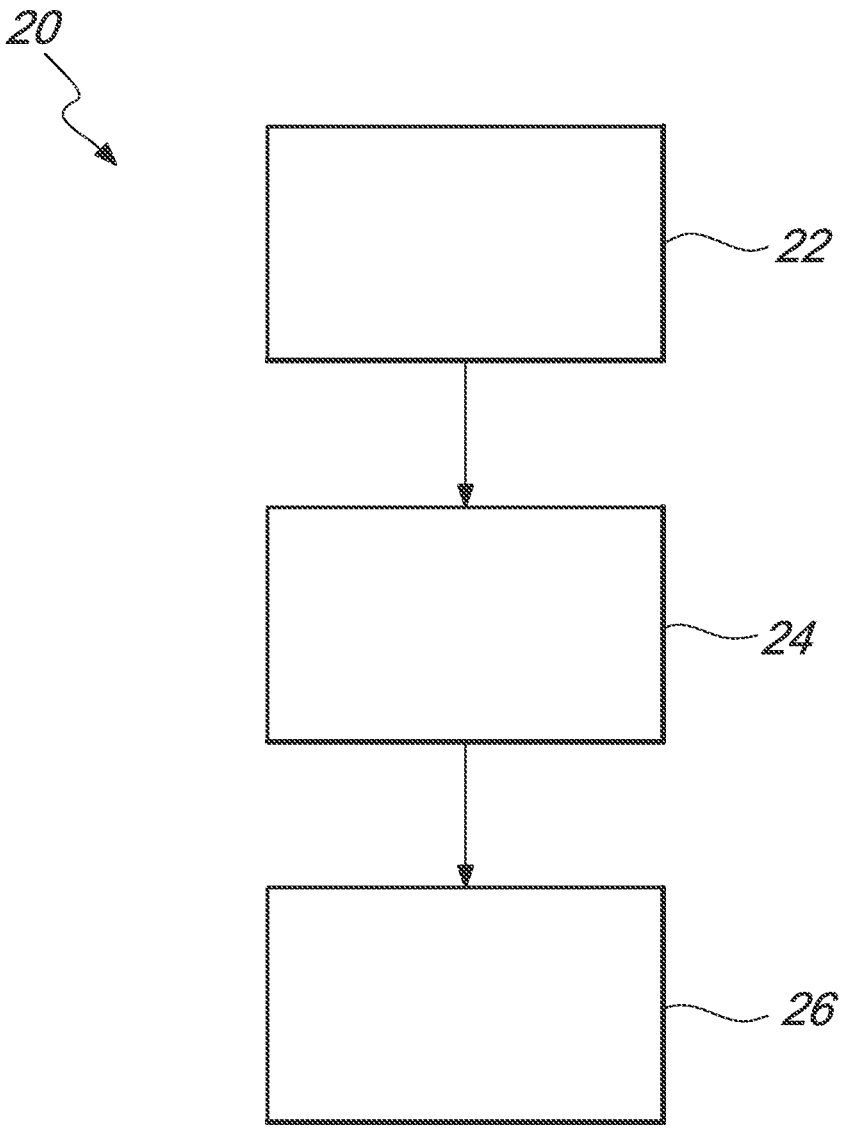
FIG. 2 is a flow chart schematically illustrating an embodiment of the method for controlling the ground grip of a wheeled loader.

With reference to FIG. 2, the method for controlling the ground grip of a wheeled loader 10 according to the invention, indicated as a whole with the reference numeral 20, substantially comprises the steps described below.

The step 22 consists in measuring the relative position of the front wheels 12*a* of the wheeled loader 10, which are lifted during the dozing operation, with respect to the ground.

In one embodiment, the measurement of the relative position of the front wheels 12*a* with respect to the ground is of a direct type, and therefore the step 22 comprises the step of measuring a pair of angular position values, respectively of the front bucket 14 and of the booms 16 of the wheeled loader 10.

In an embodiment of the invention, the measurement of the relative position of the front wheels 12*a* with respect to the ground is of an indirect type, and therefore the step 22 comprises the step of measuring a deformation value of the front axle of the wheeled loader 10, to the ends of which the front wheels 12*a* are coupled. In general, the state of deformation of the front axle can be neutral, concave or convex.

Advantageously, the measurement of the relative position of the front wheels 12*a* with respect to the ground is continuous during the execution time, to constantly update the state of the front wheels 12*a*. Preferably, this measurement is carried out every 10 milliseconds.

The step 24 comprises detecting the reaching of a critical threshold value, namely an allowed maximum threshold, by the measurement of the relative position of the front wheels

12*a* with respect to the ground, in particular comparing the measurement of the relative position of the front wheels 12*a* with respect to the ground with the critical threshold value.

Advantageously, the comparison between the measurement of the relative position of the front wheels 12*a* with respect to the ground and the critical threshold value is continuous during the execution time.

Within the scope of the embodiments described, actuation (i.e., straightening and tilting) of the front bucket 14 and actuation (i.e., lifting and lowering) of the booms 16 are considered critical operations, as exceeding the critical threshold value by the measurement of the relative position of the front wheels 12*a* with respect to the ground, i.e., lifting of the front wheels 12*a* of the wheeled loader 10 off the ground, are dependent upon them.

When the measurement of the relative position of the front wheels 12*a* with respect to the ground reaches the critical threshold value, the step 26 comprises limiting the commands that the operator can give the wheeled loader 10, in particular inhibiting or blocking a further tilting of the front bucket 14 and a further lowering of the booms 16 which would cause the critical threshold value to be exceeded by the measurement of the relative position of the front wheels 12*a* with respect to the ground, i.e., lifting of the front wheels 12*a* of the wheeled loader 10 off the ground.

Due to this operation, which avoids lifting of the front wheels 12*a* of the wheeled loader 10 off the ground, the front wheels 12*a* maintain contact and therefore grip with the ground.

In one embodiment, when the measurement of the relative position of the front wheels 12*a* with respect to the ground reaches the critical threshold value, the step 26 comprises the step of modifying the command signals for actuation of the front bucket 14 and of the booms 16.

In one embodiment, when the measurement of the relative position of the front wheels 12*a* with respect to the ground reaches the critical threshold value, the step 26 comprises the step of disabling, and consequently blocking, the command signals for a further tilting of the front bucket 14 and a further lowering of the booms 16.

Figure 3:
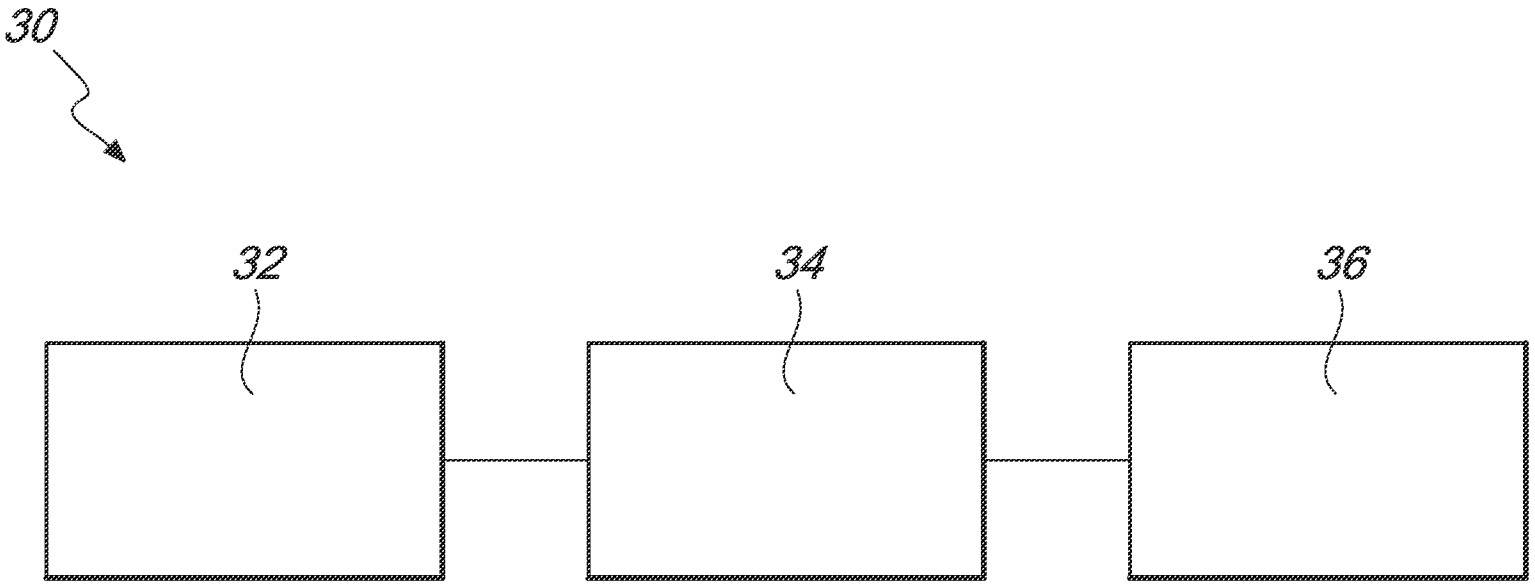
FIG. 3 is a block diagram schematically illustrating an embodiment of the system for controlling the ground grip of a wheeled loader according to the present invention.
Figure 4:
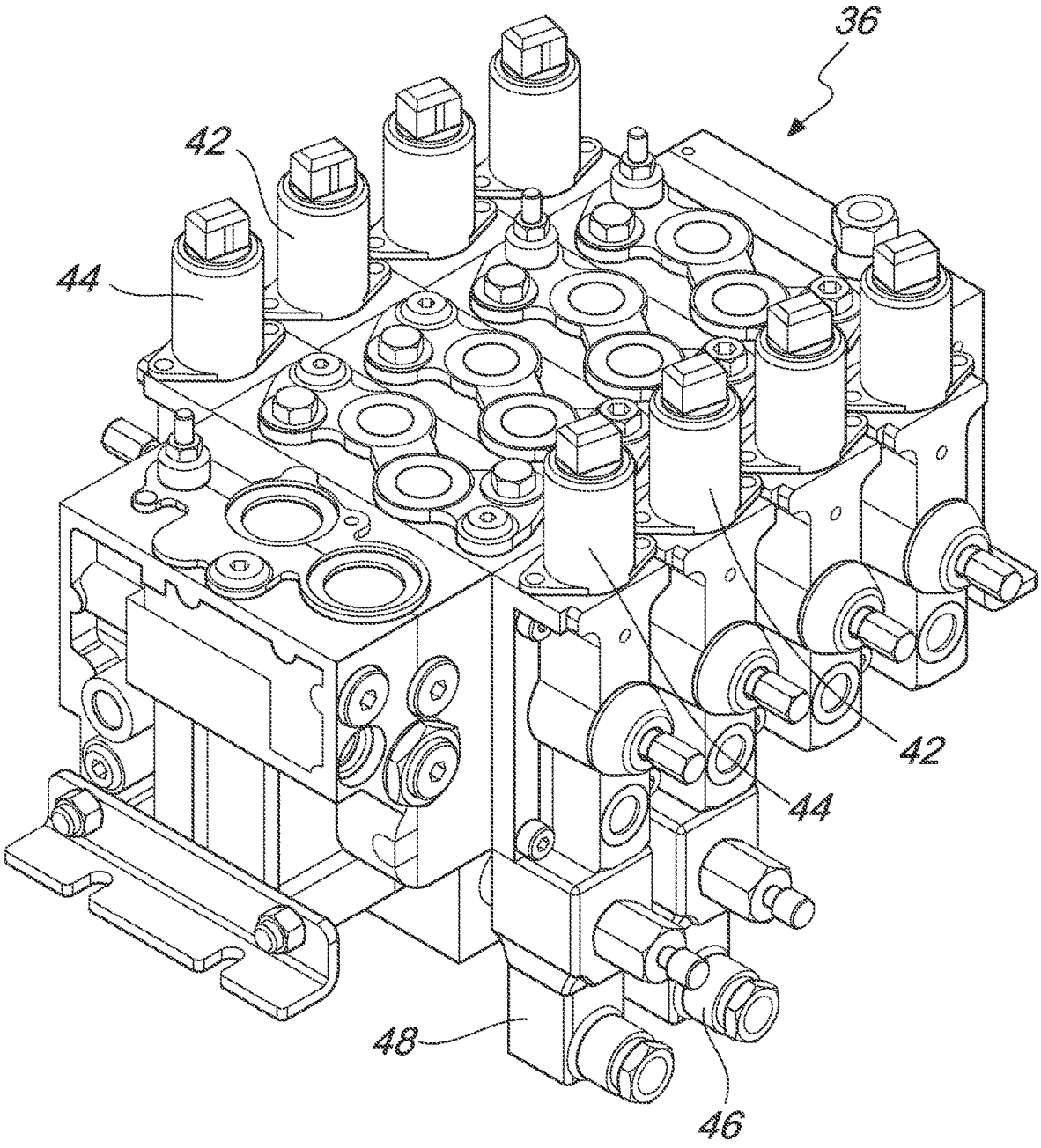
FIG. 4 is a perspective view of a hydraulic valve assembly of an embodiment of the system for controlling the ground grip of a wheeled loader.
Figure 5:
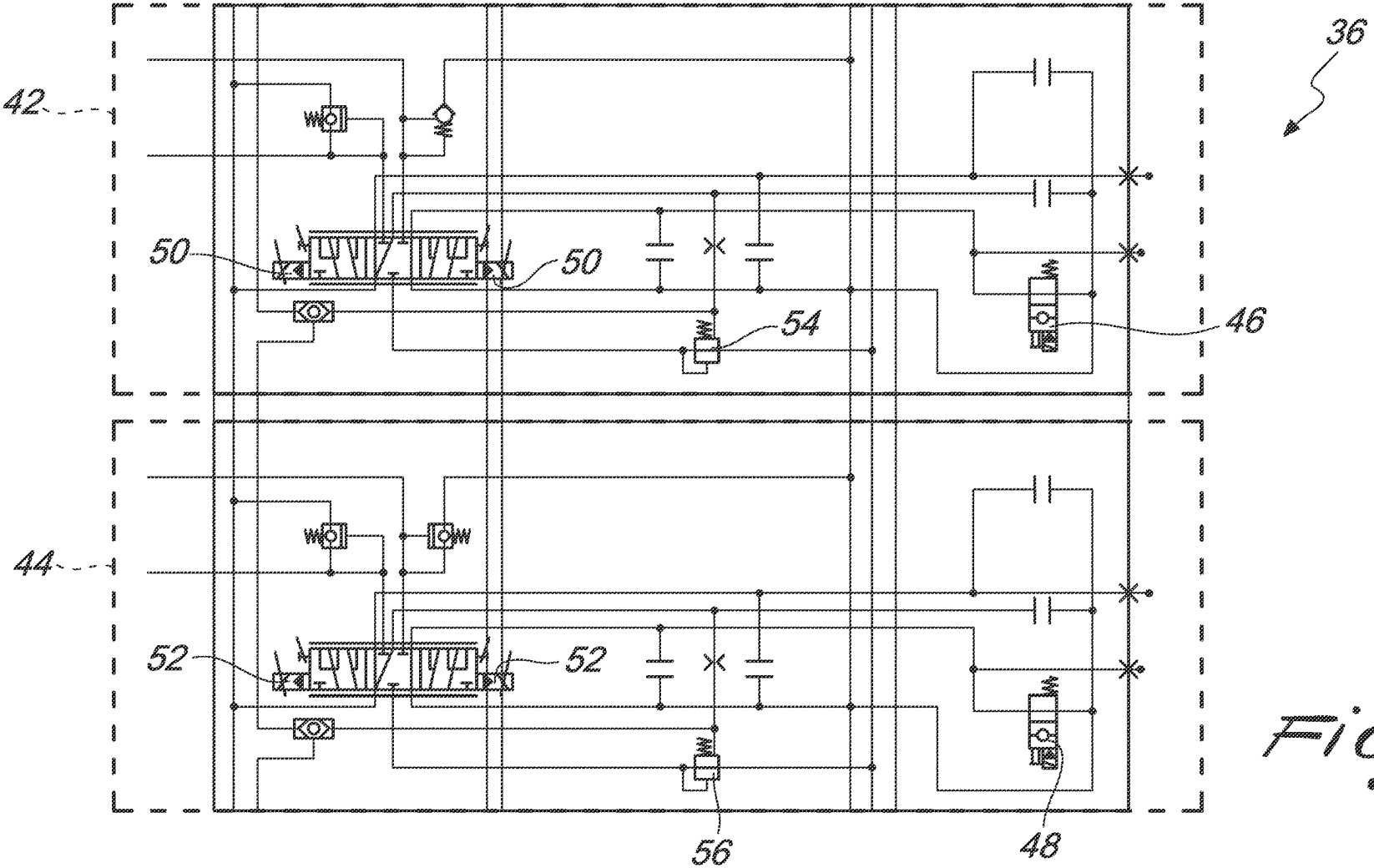
FIG. 5 is an electrohydraulic diagram of a portion of the hydraulic valve assembly of an embodiment of the system for controlling the ground grip of a wheeled loader.

With reference to FIGS. 3, 4 and 5, the system for controlling the ground grip of a wheeled loader 10 according to the invention, indicated as a whole with the reference numeral 30, substantially comprises at least one sensor device 32, an electronic control unit 34, and a hydraulic valve unit 36. Clearly, in order to be able to operate, all three of the aforesaid elements must be arranged on a wheeled loader 10.

The sensor device 32 of the system 30 for controlling the ground grip of a wheeled loader according to the invention is configured to measure the relative position of the front wheels 12*a*, which are raised during the dozing operation, with respect to the ground.

In one embodiment, the measurement of the relative position of said front wheels 12*a* with respect to the ground is of a direct type, therefore the sensor device 32 is configured to measure a pair of angular position values, respectively of the front bucket 14 and of the booms 16. To measure the angular position value of the front bucket 14, the sensor device 32 can comprise an angular sensor associated with the front bucket 14, or a linear position sensor associated with the hydraulic cylinder 18 or actuator of the front bucket 14, or both. Likewise, to measure the angular position value of the booms 16, the sensor device 32 can comprise an angular sensor associated with the booms 16, or a linear position sensor associated with the hydraulic cylinders or actuators of the booms 16, or both.

In an embodiment of the invention, the measurement of the relative position of the front wheels 12*a* with respect to the ground is of an indirect type, therefore the sensor device 32 is configured to measure a deformation value of the front axle of the wheeled loader 10, to the ends of which the front wheels 12*a* are coupled. In this case, the sensor device 32 can comprise a strain gauge, or a pressure sensor (for example a load cell), or both. In general, the state of deformation of the front axle can be neutral, concave or convex.

Advantageously, the measurement of the relative position of the front wheels 12*a* with respect to the ground is continuous during the execution time, to constantly update the state of the front wheels 12*a*. Preferably, this measurement is carried out every 10 milliseconds.

The sensor device 32 is connected to and in communication with the electronic control unit 34. In particular, the sensor device 32 is configured to transmit to the electronic control unit 34 the measurement of the relative position of the front wheels 12*a* with respect to the ground.

The electronic control unit 34 of the system 30 for controlling the ground grip of a wheeled loader according to the invention is configured to detect the reaching of a critical threshold value, i.e., an allowed maximum threshold, by the measurement of the relative position of the front wheels 12*a* with respect to the ground. In particular, the electronic control unit 34 is configured to compare the measurement of the relative position of the front wheels 12*a* with respect to the ground with the critical threshold value.

Advantageously, the comparison between the measurement of the relative position of the front wheels 12*a* with respect to the ground and the critical threshold value is continuous during the execution time.

Advantageously, the critical threshold value can be set by means of calibration of parameters in the electronic control unit 34.

When the measurement of the relative position of the front wheels 12*a* with respect to the ground reaches the critical threshold value, the electronic control unit 34 is configured to limit the commands that the operator can give the wheeled loader 10, in particular inhibiting or blocking a further tilting of the front bucket 14 and a further lowering of the booms 16 that would cause the critical threshold value to be exceeded by the measurement of the relative position of the front wheels 12*a* with respect to the ground, i.e., lifting of the front wheels 12*a* of the wheeled loader 10 off the ground.

Due to this operation of the electronic control unit 34, which avoids lifting of the front wheels 12*a* of the wheeled loader 10 off the ground, the front wheels 12*a* maintain contact and therefore grip with the ground.

In one embodiment, when the measurement of the relative position of the front wheels 12*a* with respect to the ground reaches the critical threshold value, the electronic control unit 34 is configured to modify command signals sent to the hydraulic valve assembly 36 for the actuation of the hydraulic cylinders or actuators of the front bucket 14 and of the booms 16.

In one embodiment, when the measurement of the relative position of the front wheels 12*a* with respect to the ground reaches the critical threshold value, the electronic control unit 34 is configured to disable and consequently block, the command signals for a further tilting of the front bucket 14 and a further lowering of the booms 16.

The electronic control unit 34 is connected to and in communication with the hydraulic valve assembly 36. In particular, the electronic control unit 34 is configured to transmit to the hydraulic valve assembly 36 at least one command signal, for example a proportional electrohydraulic signal to control a hydraulic valve, or a switch-on or switch-off signal of a local discharge valve of the electrical type (ON/OFF).

The hydraulic valve assembly 36 of the system 30 for controlling the ground grip of a wheeled loader according to the invention is configured to control the hydraulic flow, and therefore the transfer of hydraulic power, from the hydraulic pump of the wheeled loader 10 to the hydraulic cylinders or actuators of said wheeled loader 10. In practice, the hydraulic valve assembly 36 is configured to command actuation of the hydraulic cylinders or actuators comprised in the wheeled loader 10, including those of the front bucket 14 and of the booms 16.

As stated, within the scope of the embodiments described, the actuation (i.e., straightening and tilting) of the front bucket 14 and the actuation (i.e. lifting and lowering) of the booms 16 are considered critical actuations, as exceeding the critical threshold value by the measurement of the relative position of the front wheels 12*a* with respect to the ground, namely lifting of the front wheels 12*a* of the wheeled loader 10 off the ground, depends on them.

With reference to the critical actuations above, the hydraulic valve assembly 36 comprises a first hydraulic valve 42 that commands the actuation of the hydraulic cylinder or actuator 18 of the front bucket 14, and a second hydraulic valve 44 that commands the actuation of the hydraulic cylinders or actuators of the booms 16. In particular, the first hydraulic valve 42 alternately commands the straightening and tilting of the front bucket 14 of the wheeled loader 10, while the second hydraulic valve 44 alternately commands the lifting and lowering of the booms 16 of the wheeled loader 10. Preferably, the hydraulic valves 42 and 44 of the hydraulic valve assembly 36 are of the pre-compensated type with load sensing.

Each of the hydraulic valves 42 and 44 of the hydraulic valve assembly 36 is controlled by a respective proportional electrohydraulic signal 50 and 52. In particular, the first hydraulic valve 42 which commands the actuation of the front bucket 14 is controlled by a first proportional electrohydraulic signal 50, while the second hydraulic valve 44 which commands the actuation of the booms 16 is controlled by a second proportional electrohydraulic signal 52.

In one embodiment, when the measurement of the relative position of the front wheels 12*a* with respect to the ground reaches the critical threshold value, the electronic control unit 34 is configured to set to neutral the first 50 and the second 52 proportional electrohydraulic signals transmitted to the hydraulic valve assembly 36, in particular sent respectively to the first 42 and to the second 44 hydraulic valve which controls the critical actuations. Moreover, the electronic control unit 34 can be configured to enable the first electrohydraulic signal 50 only for a straightening of the front bucket 14 and the second proportional electrohydraulic signal 52 only for lifting of the booms 16, i.e., movements opposite to those that would cause the critical threshold valve to be exceeded by the measurement of the relative position of the front wheels 12*a* with respect to the ground, namely the lifting of the front wheels 12*a* of the wheeled loader 10 off the ground.

In one embodiment, each of the hydraulic valves 42 and 44 of the hydraulic valve assembly 36, as stated preferably of the pre-compensated type with load sensing, is provided with a respective local discharge valve 46 and 48 of the electrical type (ON/OFF), configured to discharge to a reservoir the respective load sensing signal of a single work port. In particular, the first hydraulic valve 42 which commands tilting of the front bucket 14 is provided with a first local discharge valve 46, while the second hydraulic valve 44 which commands lowering of the booms 16 is provided with a second local discharge valve 48.

In this embodiment, when the measurement of the relative position of the front wheels 12*a* with respect to the ground reaches the critical threshold value, the electronic control unit 34 is configured to switch-off (OFF) the first 46 and the second 48 local discharge valves, discharging to a reservoir the respective load sensing signals of a single work port. By doing so, the first local compensator 54 of the first hydraulic valve 42 is prevented from providing the hydraulic flow required for tilting of the front bucket 14, and the second local compensator 56 of the second hydraulic valve 44 is prevented from providing the hydraulic flow required for lowering of the booms 16.

In practice, it has been ascertained how the invention fully achieves the intended aim and objects. In particular, it has been seen how the method and the system for controlling the ground grip of a wheeled loader thus conceived, allow to overcome the qualitative limits of the state of the art, as they make it possible to reduce the transmission failure rate, above all of the relative rear axle, of the wheeled loaders engaged in dozing, bringing it back to average values.

Figure 1B:
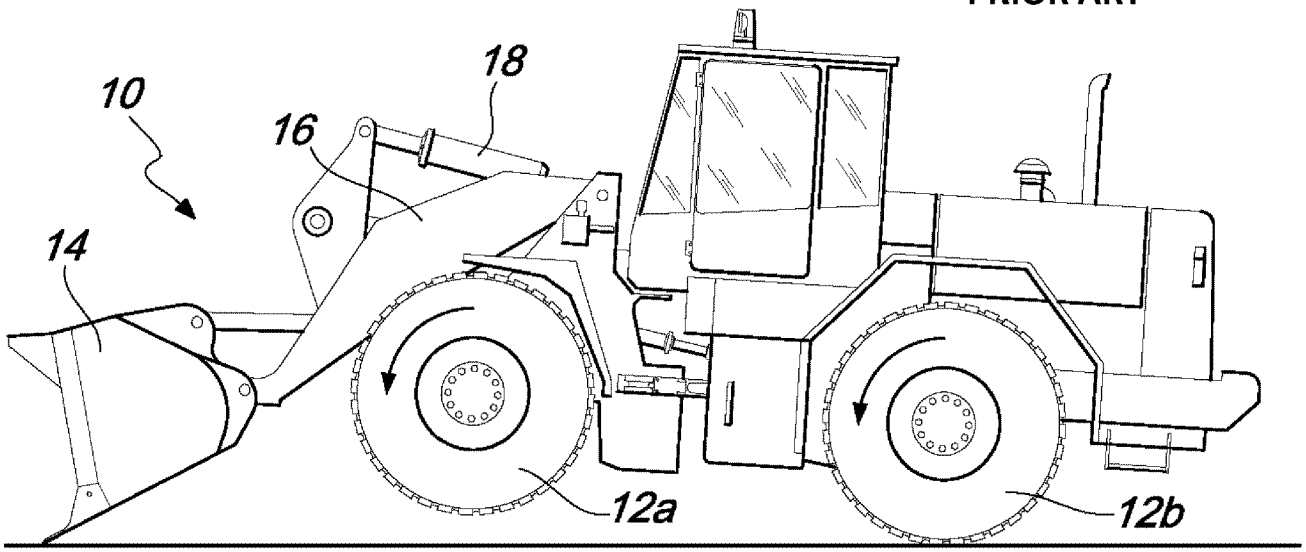
Fig. 1B PRIOR ART

An advantage of the method and of the system for controlling the ground grip of a wheeled loader according to some embodiments consist in the fact that they make it possible to avoid lifting of the front wheels of the wheeled loader engaged in dozing off the ground, such as for example illustrated in FIG. 1B.

Another advantage of the method and of the system for controlling the ground grip of a wheeled loader according to some embodiments consist in the fact that they make it possible to optimize and harmonize damping of the mode shape of the transmission of wheeled loaders engaged in dozing.

A further advantage of the method and of the system for controlling the ground grip of a wheeled loader according to so some embodiments consist in the fact that they make it possible to maximize the tensile stress capacity of wheeled loaders engaged in dozing, preventing slipping of the relative wheels.

Yet another advantage of the method and of the system for controlling the ground grip of a wheeled loader according to some embodiments consist in the fact that they make it possible to obtain improved effects with respect to those obtainable with the known art solutions and/or similar effects at lower cost and with higher performances.

Although the method and the system for controlling the ground grip of a wheeled loader according to the invention have been conceived in particular for wheeled loaders engaged in the field of waste movement within a landfill, they can in any case be used, more generally, for any wheeled loader suitable to carry out dozing maneuver.

The invention thus conceived is susceptible to numerous modifications and variants, all falling within the scope of the inventive concept. Moreover, all details can be replaced by other technically equivalent elements.

In practice, the materials used, as long as they are compatible with the specific use, and the contingent shapes and dimensions may be any according to requirements and to the state of the art.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

It will be appreciated that the configurations and routines disclosed herein are exemplary in nature, and that these specific embodiments are not to be considered in a limiting sense, because numerous variations are possible. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, are also regarded as included within the subject matter of the present disclosure.

In conclusion, the scope of protection of the claims must not be limited by the illustrations or by the preferred embodiments illustrated in the description in the form of examples, but rather the claims must comprise all the features of patentable novelty residing in the embodiments described, including all those features that would be treated as equivalent by the person skilled in the art.

The invention claimed is:

1. A method for controlling the ground grip of a wheeled loader, said wheeled loader comprising a pair of front wheels, a bucket and at least one boom, wherein the method comprises the steps of:

measuring the relative position of said front wheels with respect to the ground;

detecting the reaching of a critical threshold value by the measurement of said relative position of said front wheels with respect to the ground;

comparing the measurement of said relative position of said front wheels with respect to the ground with said critical threshold value; and when the measurement of said relative position of said front wheels with respect to the ground reaches said critical threshold value, inhibiting a further tilting of said bucket and a further lowering of said at least one boom.

2. The method for controlling ground grip according to claim 1, wherein said measurement step comprises the step of measuring a pair of angular position values, respectively of said bucket and of said at least one boom.

3. The method for controlling ground grip according to claim 1, wherein said measurement step comprises the step of in measuring a deformation value of a front axle of said wheeled loader, to the ends of which said front wheels are coupled.

4. The method for controlling ground grip according to claim 1, wherein said inhibition step comprises the step of modifying command signals for the actuation of said bucket and of said at least one boom.

5. The method for controlling ground grip according to claim 1, wherein said inhibition step comprises the step of disabling command signals for said further tilting of said bucket and said further lowering of said at least one boom.

6. A system for controlling the ground grip of a wheeled loader, said wheeled loader comprising a pair of front wheels, a bucket and at least one boom, said system comprising at least one sensor device and an electronic control unit, wherein:

said at least one sensor device is configured to measure the relative position of said front wheels with respect to the ground;

said electronic control unit is configured to detect the reaching of a critical threshold value on the part of the measurement of said relative position of said front wheels with respect to the ground, comparing the measurement of said relative position of said front wheels with respect to the ground with said critical thresh-old value; and when the measurement of said relative position of said front wheels with respect to the ground reaches said critical threshold value, said electronic control unit is configured to inhibit a further tilting of said bucket and a further lowering of said at least one boom.

7. The system for controlling ground grip according to claim 6, wherein said at least one sensor device is configured to measure a pair of angular position values, respectively of said bucket and of said at least one boom.

8. The system for controlling ground grip according to claim 6, wherein said at least one sensor device is configured to measure a value of deformation of a front axle of said wheeled loader, to the ends of which said front wheels are coupled.

9. The system for controlling ground grip according to claim 6, comprising a hydraulic valve assembly configured to control the actuation of hydraulic cylinders of said wheeled loader, wherein when the measurement of said relative position of said front wheels with respect to the ground reaches said critical threshold value, said electronic control unit is configured to modify control signals directed to said hydraulic valve assembly for the actuation of said hydraulic cylinders of said bucket and of said at least one boom.

10. The system for controlling ground grip according to claim 9, wherein said hydraulic valve assembly comprises a first hydraulic valve controlled by a first proportional electrohydraulic signal, which controls the actuation of a hydraulic cylinder of said bucket, and a second hydraulic valve controlled by a second proportional electrohydraulic signal, which controls the actuation of at least one hydraulic cylinder of said at least one boom.

11. The system for controlling ground grip according to claim 10, wherein when the measurement of said relative position of said front wheels with respect to the ground reaches said critical threshold value, said electronic control unit is configured to set to neutral said first electrohydraulic signal and said second proportional electrohydraulic signal transmitted to said hydraulic valve assembly.

12. The system for controlling ground grip according to claim 11, wherein said electronic control unit is further configured to enable said first electrohydraulic signal only for a straightening of said bucket and said second proportional electro-hydraulic signal only for an upward motion of said at least one boom.

13. The system of claim 9, wherein said at least one sensor device is configured to measure a pair of angular position values, respectively of said bucket and of said at least one boom.

14. The system of claim 9, wherein said at least one sensor device is configured to measure a value of deformation of a front axle of said wheeled loader, to the ends of which said front wheels are coupled.

15. The system for controlling ground grip according to claim 6, comprising a hydraulic valve assembly configured to control the actuation of hydraulic cylinders of said wheeled loader, wherein when the measurement of said relative position of said front wheels with respect to the ground reaches said critical threshold value, said electronic control unit is configured to disable control signals for said further tilting of said bucket and said further lowering of said at least one boom.

16. The system for controlling ground grip according to claim 15, wherein said hydraulic valve assembly comprises a first hydraulic valve controlled by a first proportional electrohydraulic signal, which controls the actuation of a hydraulic cylinder of said bucket, and a second hydraulic valve controlled by a second proportional electrohydraulic signal, which controls the actuation of at least one hydraulic cylinder of said at least one boom, wherein said first hydraulic valve and said second hydraulic valve of said hydraulic valve assembly are of the pre-compensated type with load sensing and are provided with respective local discharge valves of the electrical type, and in that when the measurement of said relative position of said front wheels with respect to the ground reaches said critical threshold value, said electronic control unit is configured to turn off said local discharge valves, discharging to the reservoir respective load sensing signals.

17. The system of claim 15, wherein said hydraulic valve assembly comprises a first hydraulic valve controlled by a first proportional electrohydraulic signal, which controls the actuation of a hydraulic cylinder of said bucket, and a second hydraulic valve controlled by a second proportional electrohydraulic signal, which controls the actuation of at least one hydraulic cylinder of said at least one boom.

18. The system of claim 15, wherein said at least one sensor device is configured to measure a pair of angular position values, respectively of said bucket and of said at least one boom.

19. The system of claim 15, wherein said at least one sensor device is configured to measure a value of deformation of a front axle of said wheeled loader, to the ends of which said front wheels are coupled.

20. A method for controlling a wheeled loader during a dozing operation so as to control lifting of front wheels of the wheeled loader off of a ground, the method comprising: using at least one sensor device to measure a relative position of the front wheels with respect to the ground during the dozing operation; using an electronic control unit to detect when the relative position reaches a threshold value; and, when the relative position reaches the threshold value, using the electronic control unit to inhibit both a further tilting of a bucket of the wheeled loader and a further lowering of at least one boom, the bucket and the at least one boom configured on the wheeled loader so as to permit the dozing operation.

* * * * *